US006863572B1

(12) United States Patent
Yi et al.

(10) Patent No.: US 6,863,572 B1
(45) Date of Patent: Mar. 8, 2005

(54) ELECTRICAL CONNECTOR WITH SHOCK SUPPORT

(75) Inventors: Chong Hun Yi, Mechanicsbur, PA (US); Joanne E. Shipe, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 3 days.

(21) Appl. No.: 10/644,352

(22) Filed: Aug. 19, 2003

(51) Int. Cl.[7] ..... H01R 24/00
(52) U.S. Cl. ..... 439/637; 439/59; 439/65
(58) Field of Search ..... 439/637, 60, 108, 439/924.1, 374, 377, 633, 59, 62, 65

(56) References Cited

U.S. PATENT DOCUMENTS 4,241,381 A * 12/1980 Cobaugh et al. ..... 361/785
4,349,237 A * 9/1982 Cobaugh et al. ..... 439/377
5,971,800 A * 10/1999 Azuma et al. ..... 439/502
6,007,352 A * 12/1999 Azuma et al. ..... 439/108
6,347,039 B1 * 2/2002 Lee ..... 361/760
6,645,002 B1 * 11/2003 Lee ..... 439/497

* cited by examiner

*Primary Examiner*—Gary Paumen
*Assistant Examiner*—Edwin A. Leon
(74) *Attorney, Agent, or Firm*—Wei Te Chung

(57) ABSTRACT

An electrical connector (1) adapted for electrically receiving a daughter PCB (6) includes an insulative housing (2, 2*a*, 2*b*, 2*c*, 2*d*), a signal terminal (3, 3*a*, 3*b*, 3*c*, 3*d*) and a power contact (4, 4*a*, 4*b*, 4*c*, 4*d*). The insulative housing includes a receiving slot (200) for receiving the daughter PCB and a tower (22, 22*a*, 22*b*, 22*c*, 22*d*). The signal terminal is retained in the insulative housing for electrically connecting with the PCB. The power contact is retained in the tower electrically connecting with the daughter PCB.

12 Claims, 9 Drawing Sheets

ELECTRICAL CONNECTOR WITH SHOCK SUPPORT

BACKGROUND OF THE INVENTION

1. Field of the Invention

The present invention relates to an electrical connector, and particularly to an electrical connector with shock support.

2. Description of Related Art

Card edge connectors, such as a PCI and a PCI Express connectors, are widely used to connect daughter Printed Circuit Boards (PCBs) and mother PCBs. Typically, each of the card edge connectors has an elongate insulative housing and a plurality of signal terminals retained in the insulative housing. The insulative housing defines an elongate receiving slot for receiving the daughter PCB. In common, a tower is formed on the insulative housing at a lateral end thereof and functions as a shock support. Thus, a large space of the mother PCB is occupied by the tower and is wasted. On the other hand, if there is power to transmit, a separate power connector is required to be mounted on the mother PCB. Thus, some space is wasted. For fast developing science, the PCB is reduced in size and has no redundant space to waste for the tower and the separate power connector.

Hence, an improved card edge connector with improved shock support is required to overcome the disadvantages of the conventional card edge connector.

SUMMARY OF THE INVENTION

Accordingly, an object of the present invention is to provide a card edge connector having a tower with a power contact retained therein.

In order to achieve the object set forth, an electrical connector of the present invention is adapted for electrically receiving a daughter PCB. The electrical connector comprises an insulative housing, a signal terminal retained in the insulative housing and a power contact. The insulative housing includes a receiving slot for an insertion of the daughter PCB and a tower functioning as a shock support. The power contact is received in the tower for electrically connecting with the daughter PCB.

Other objects, advantages and novel features of the invention will become more apparent from the following detailed description when taken in conjunction with the accompanying drawings.

DETAILED DESCRIPTION OF PREFERRED EMBODIMENTS

Figure 1:
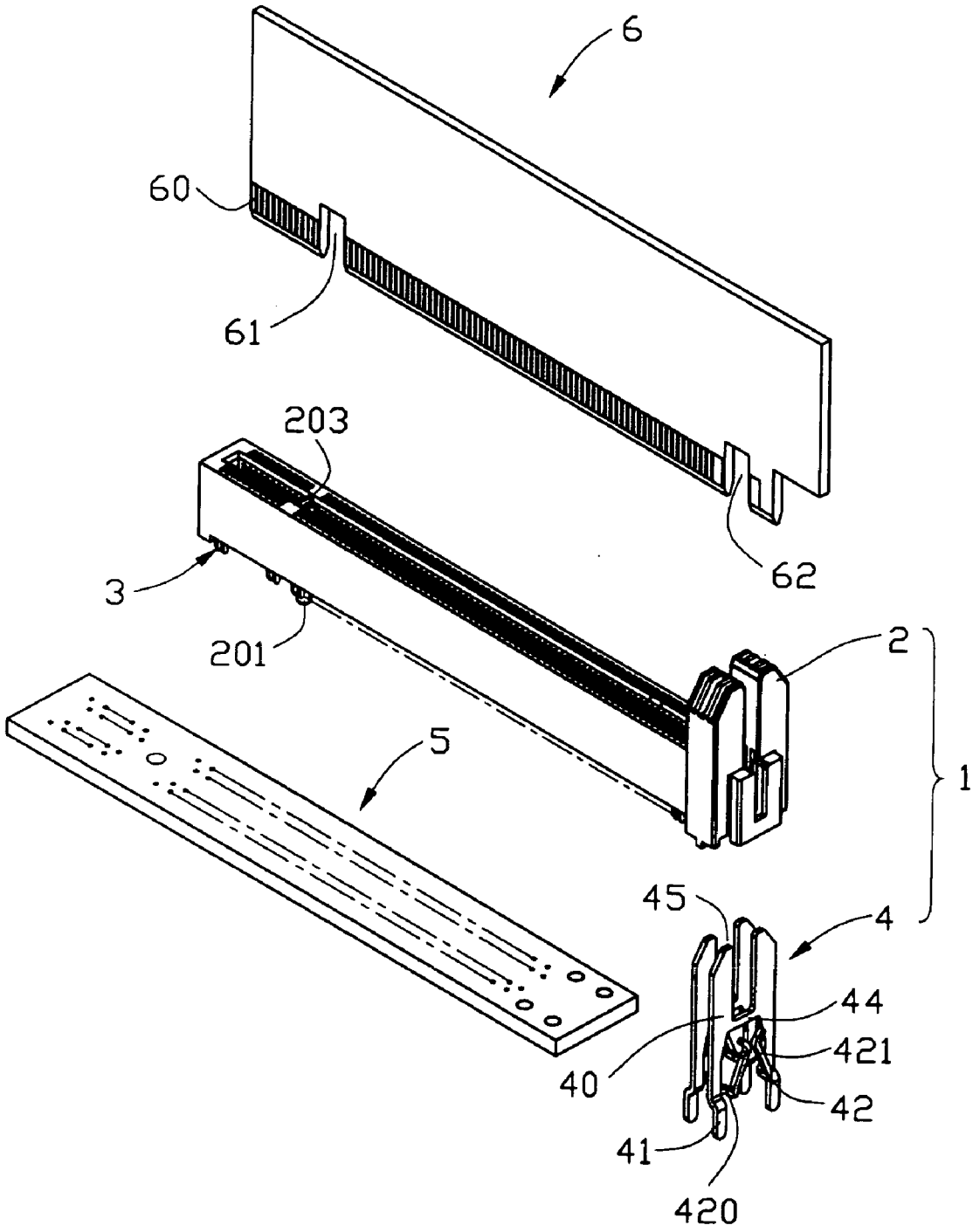
FIG. 1 is a top, front and right perspective view of an electrical connector in accordance with a first embodiment of the present invention, a mother PCB and a daughter PCB.

Reference will now be made to the drawing figures to describe the present invention in detail.

Figure 2:
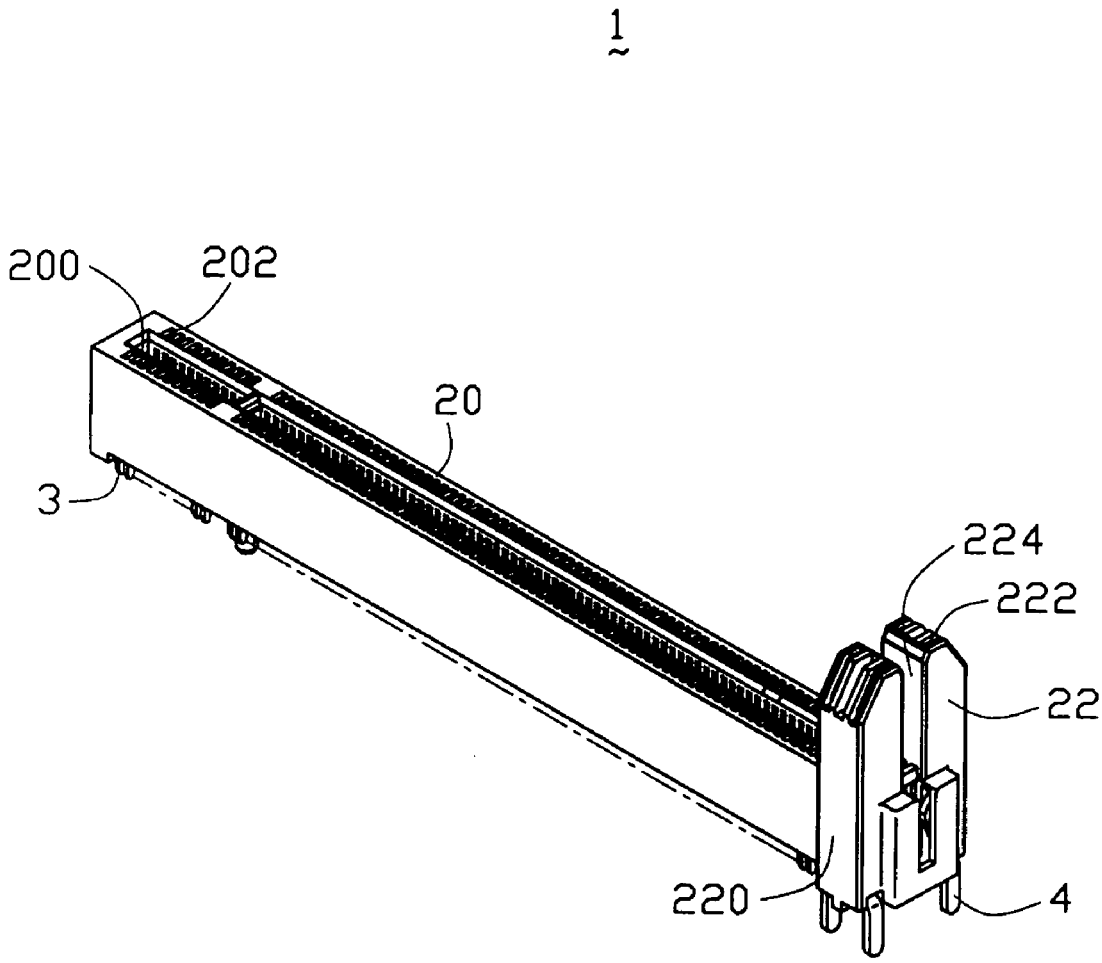
FIG. 2 is an assembled view of the electrical connector of FIG. 1.
Figure 3:
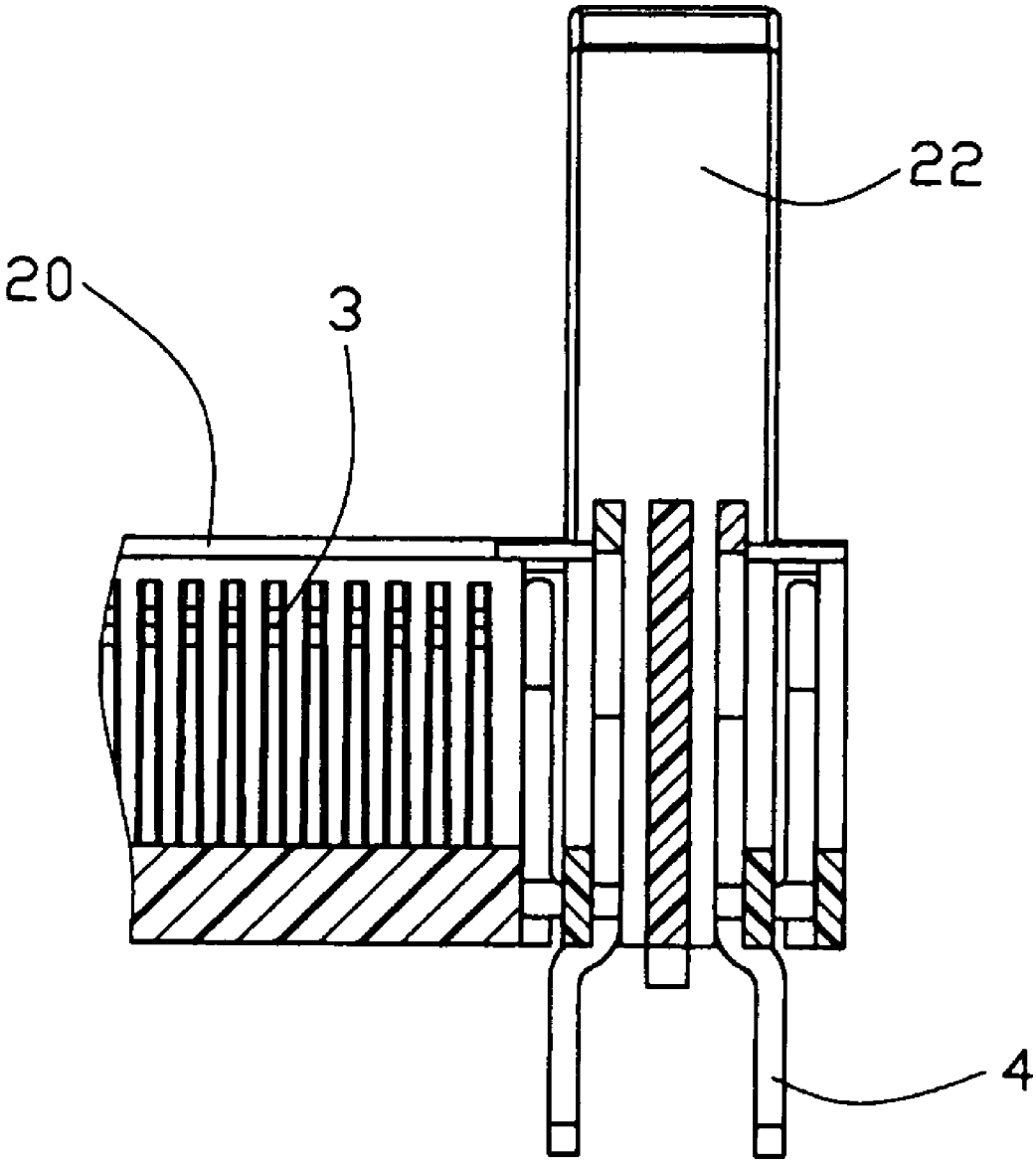
FIG. 3 is a partial, cross-sectional view of the electrical connector in FIG. 2.

Referring to FIGS. 1 and 2, a card edge connector 1 in accordance with a first embodiment of the present invention is shown. The electrical connector 1, such as a PCI connector or a PCI Express connector, includes an elongate insulative housing 2, a plurality of signal terminals 3 received in the insulative housing 2 and a pair of power contacts 4 retained in the insulative housing 2.

The insulative housing 2 includes a substantially rectangular dielectric base 20 and a tower 22 at a lateral end thereof. Furthermore, the insulative housing 2 defines a central receiving channel 200 in both the dielectric base 20 and the tower 22 for receiving a complementary daughter PCB 6. The dielectric base 20 defines two rows of opposite receiving passageways 202 communicating with the receiving channel 200. In addition, the dielectric base 20 includes a guiding wall 203 and a guiding pole 201 extending downwardly from a bottom surface thereof for being engageably received in a mother PCB 5 on which the electrical connector 1 is mounted.

The tower 22 includes a pair of opposite base portions 220 and the channel 200 is defined between the two base portions 220. Each base portion 220 defines a pair of opposite receiving slots 222 for receiving the power contacts 4. The receiving slots 222 communicate with the receiving channel 200 at a bottom thereof.

The power contacts 4 each include a pair of opposite retaining plates 40, a connecting arm 44 connecting the two retaining plates 40 together, a pair of soldering tails 41 respectively offsetting from a bottom end of the retaining plates 40 and a pair of offsetting mating arms 42 extending from a lower end of the retaining plates 40. The retaining plates 40 and the connecting arm 44 together defines a receiving recess 45 for receiving the daughter PCB 6. The mating arms 42 each comprise a horizontal arm 420 extending horizontally from the lower end of the retaining plate 40 and a curved contacting arm 421 extending upwardly and inwardly from an end of the horizontal arm 420.

In assembly, the power contacts 4 and the signal terminals 3 are inserted into the insulative housing 2 from a bottom-to-top direction. The signal terminals 3 are received in the receiving passageways 202 with contacting portions (not shown) thereof projecting into the receiving channel 200 for electrical connecting with corresponding golden fingers 60 of the daughter PCB 6. The power contacts 4 are received in the tower 22 with the retaining plate 40 respectively received in the receiving slots 222. The inner walls 224 of the tower 22 are received in the receiving recesses 45 of the power contacts 4.

Figure 4:
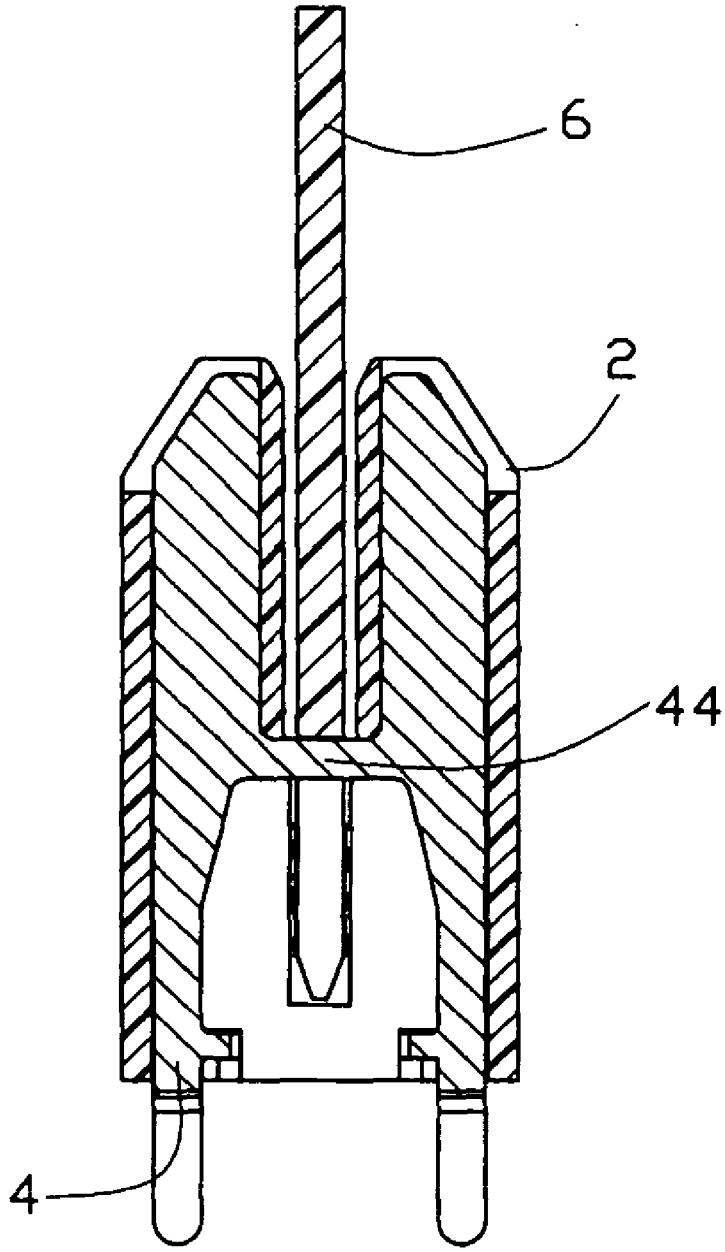
FIG. 4 is a cross-sectional view of the electrical connector of FIG. 2, showing a daughter PCB received in the electrical connector.
Figure 5:
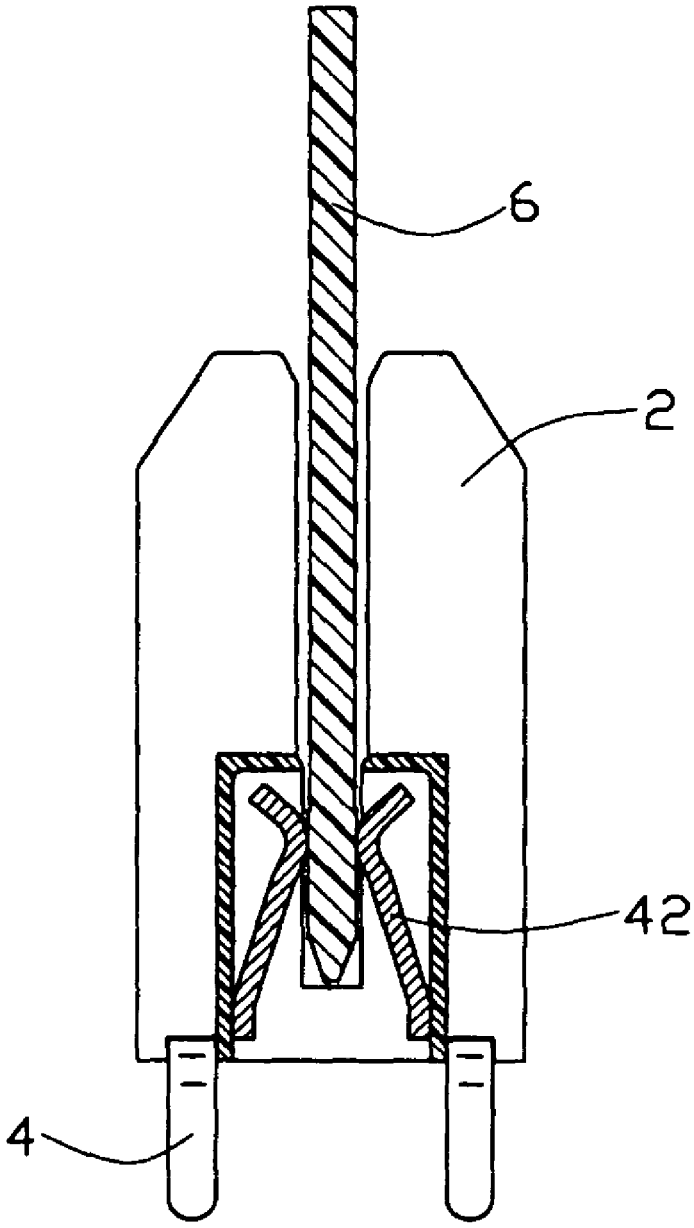
FIG. 5 is a cross-sectional view of the electrical connector of FIG. 2, showing an engagement between a power contact and the daughter PCB.

While the electrical connector 1 is mounted on the mother PCB 5, the signal terminals 3 and the power contacts 4 are soldered on the mother PCB 5. Referring to FIGS. 4 and 5, in assembling the daughter PCB 6 to the electrical connector 1, the daughter PCB 6 is received in the receiving channel 200 of the insulative housing 2 with golden fingers 60 of the daughter PCB 6 respectively contacting with the signal terminals 3 and the mating arms 42 of the power contacts 4. The guiding wall 203 of the insulative housing 2 is received in a first guiding recess 61 of the daughter PCB 6 and the connecting arms 44 of the power contacts 4 are engageably received in a second guiding recess 62 of the daughter PCB 6.

Figure 6:
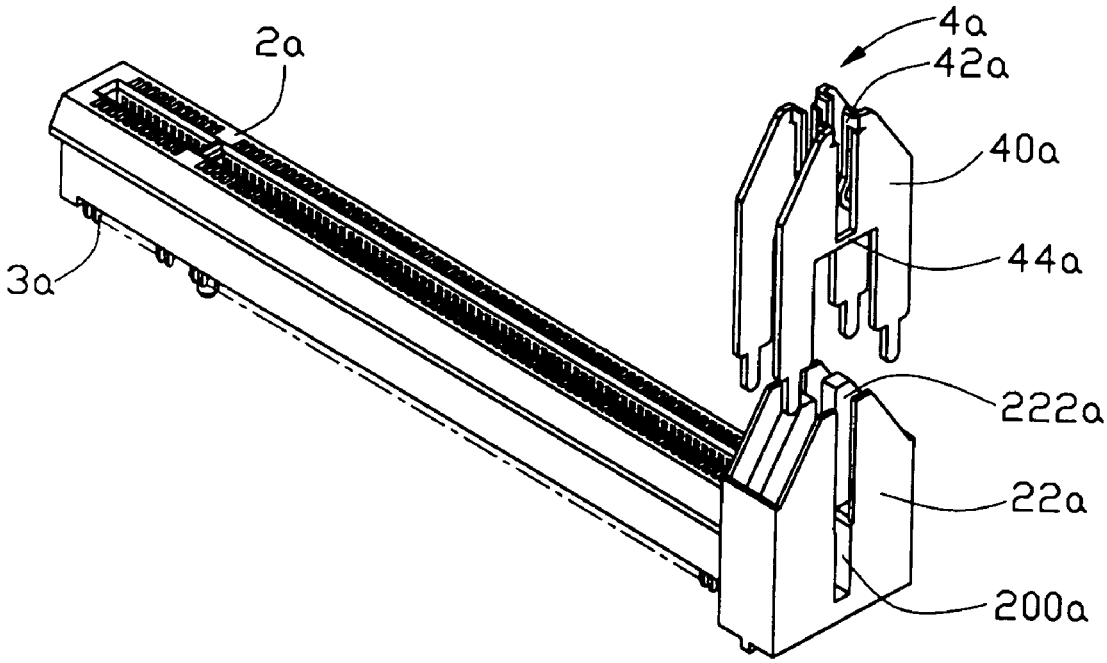
FIG. 6 is a front, right perspective view of an electrical connector in accordance with a second embodiment of the present invention.

FIG. 6 shows a design in accordance with a second embodiment of the present invention. In this embodiment, the configurations of the signal terminals 3*a* and the insulative housing 2*a* are similar to those of the first embodiment, so descriptions thereabout are omitted herefrom. A tower 22*a* is formed on the insulative housing 2*a* and defines a pair of opposite receiving slot 222*a* communicating with a receiving channel 200*a* of the insulative housing 2*a* at a top end thereof. A pair of opposite power contacts 4*a* is inserted into the tower 22*a* from a top-to-bottom direction and each have a substantial H-shape. Each power contact 4*a* comprises a pair of opposite retaining plates 40*a*, a connecting arm 44*a* connecting the retaining plates 40*a* together and a pair of offsetting mating arms 42*a* respectively extending downwardly from a top end of the retaining plates 40*a*. The relationships between the power contacts 4*a* and the insulative housing 2*a* are similar to those of the first embodiment, so descriptions thereabout are omitted herefrom.

Figure 7:
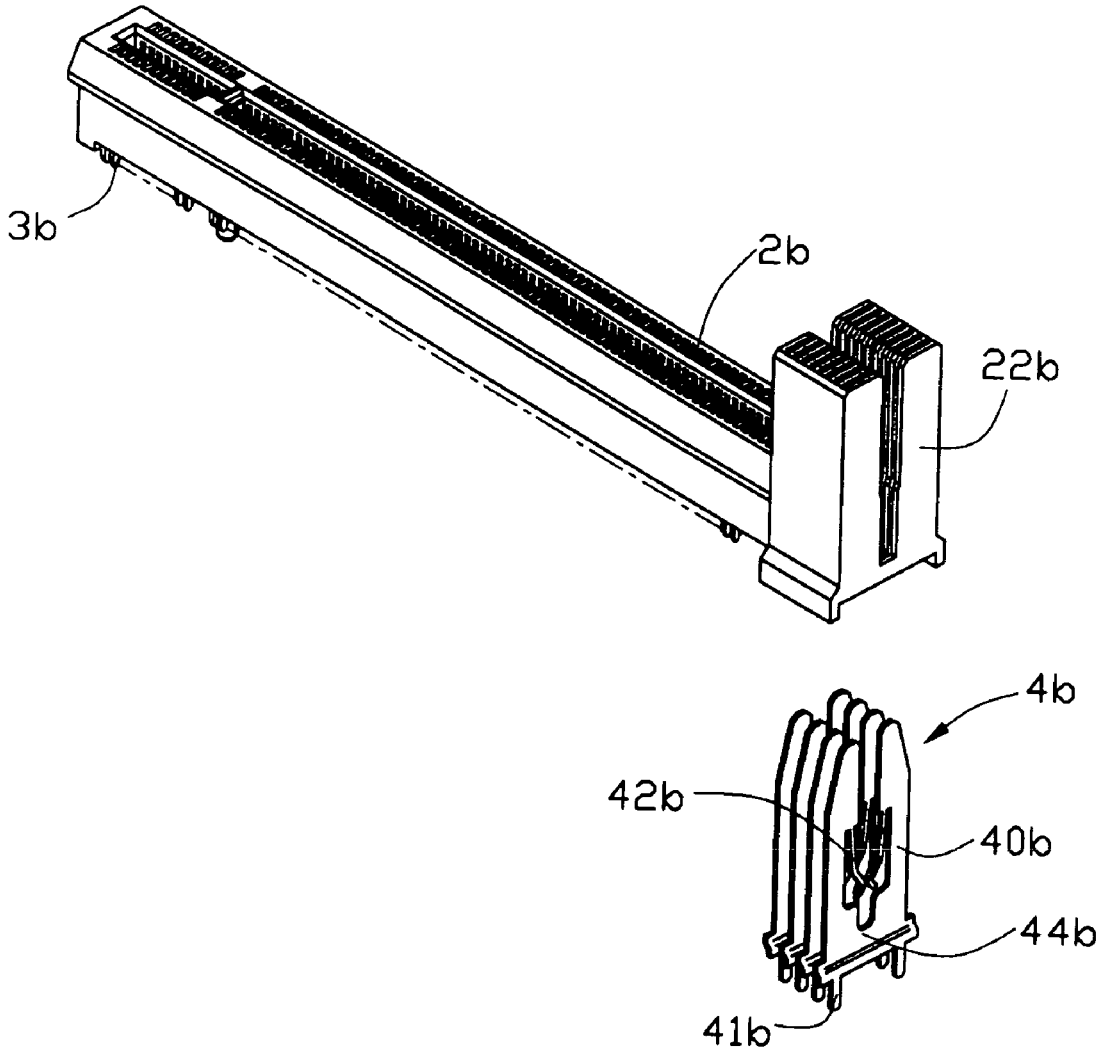
FIG. 7 is a front, right perspective view of an electrical connector in accordance with a third embodiment of the present invention.

FIG. 7 shows a design in accordance with a third embodiment of the present invention. In this embodiment, the configurations of the insulative housing 2*b* and the signal terminals 3*b* are similar to those of the first embodiment, so descriptions thereabout are omitted herefrom. A plurality of power contacts 4*b* is inserted into the insulative housing 2*b* from a bottom-to-top direction. Each of the power contact 4*b* comprises a pair of retaining plates 40*b*, a connecting arm 44*b* connecting the retaining plates 40*b* and a pair of soldering tails 41*b* extending downwardly from the connecting arm 44*b*. A pair of offsetting mating arms 42*b* extends downwardly and inwardly from an inner side of the retaining plates 40*b*. The relationships between the power contacts 4*b* and the insulative housing 2*b* are similar to those of the first embodiment, so descriptions thereabout are omitted herefrom.

Figure 8:
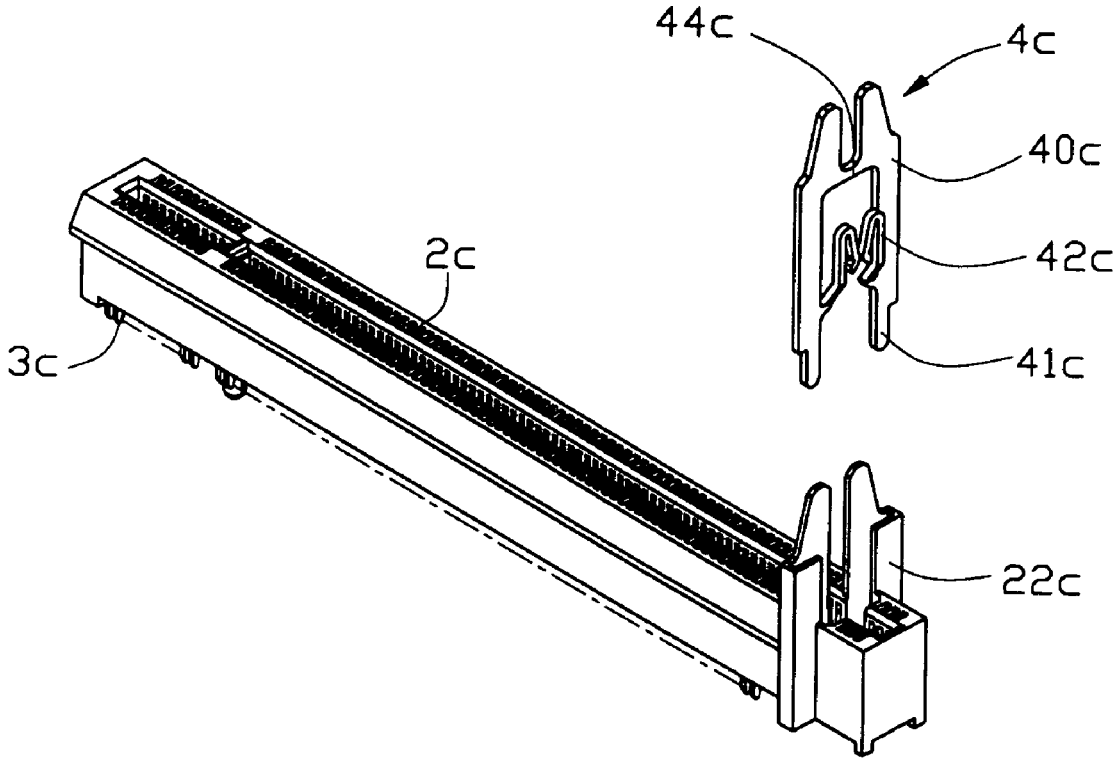
FIG. 8 is a front, right perspective view of an electrical connector in accordance with a fourth embodiment of the present invention.

FIG. 8 shows a design in accordance with a forth embodiment of the present invention. In this embodiment, the configurations of the insulative housing 2*c* and the signal terminals 3*c* are similar to those of the first embodiment, so descriptions thereabout are omitted herefrom. The insulative housing 2*c* is formed with a tower 22*c* at a distance from a lateral end thereof. A power contact 4*c* is inserted into the tower 22*c* from a top-to-bottom direction. The power contacts 4*c* comprises a pair of retaining plates 40*c*, a connecting arm 44*c* connecting the retaining plates 40*c* together, a pair of soldering tails 41*c* respectively extending downwardly from a bottom end of the retaining plates 40*c*, and a pair of mating arms 42*c* extending upwardly and inwardly from the bottom end of the retaining plates 40*c*. The relationships between the power contacts 4*c* and the insulative housing 2*c* are similar to those of the first embodiment, so descriptions thereabout are omitted herefrom.

Figure 9:
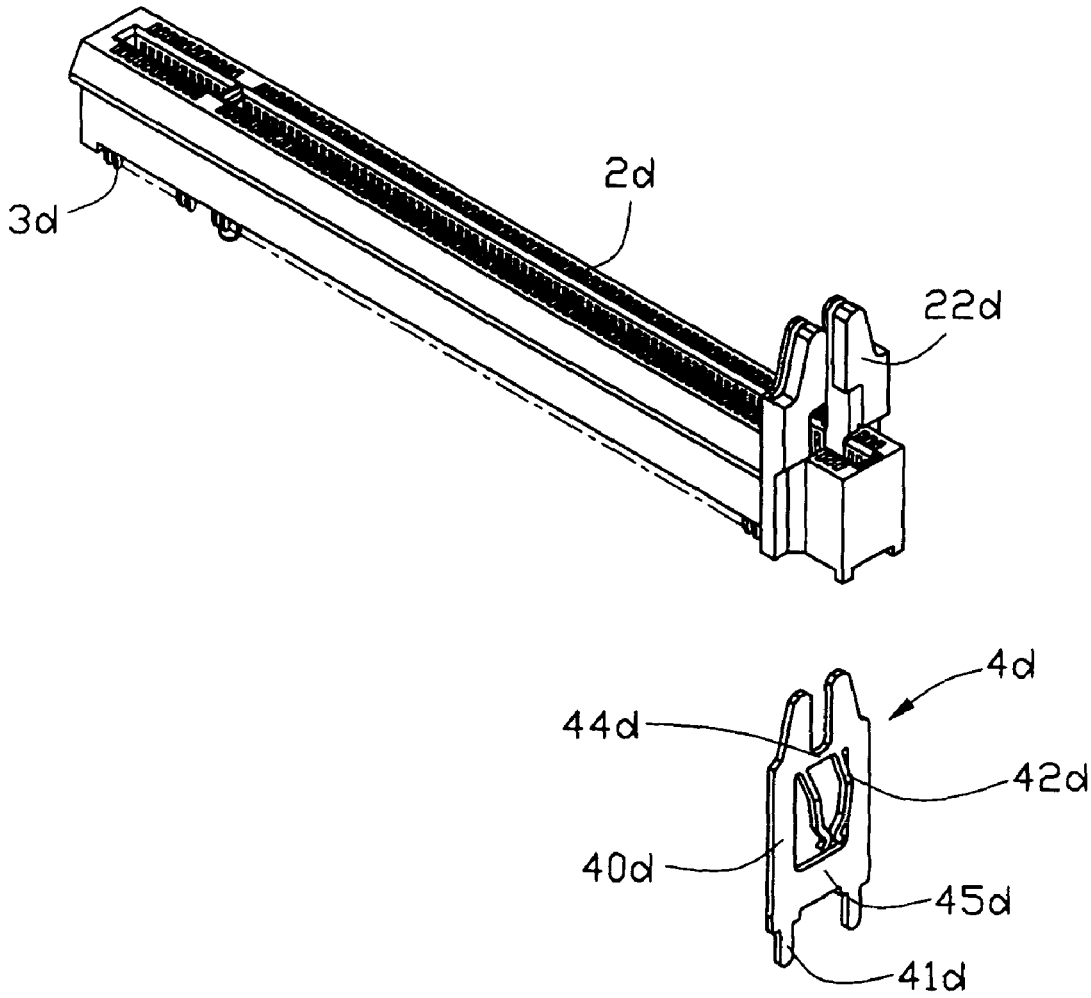
FIG. 9 is a front, right perspective view of an electrical connector in accordance with a fifth embodiment of the present invention.

FIG. 9 shows a design in accordance with a fifth embodiment of the present invention. In this embodiment, the configurations of the insulative housing 2*d* and the signal terminals 3*d* are similar to those of the first embodiment, so descriptions thereabout are omitted herefrom. The insulative housing 2*d* is formed with a tower 22*d* at a distance from an end of the insulative housing 2*d*. The power contact 4*d* is inserted into the tower 22*d* from a bottom-to-top direction and comprises a pair of retaining plates 40*d*, a pair of soldering tails 41*d* extending downwardly from a bottom end of the retaining plates 40*d*, a pair of upper and lower connecting arms 44*d*, 45*d* connecting the retaining plates 40*d* together. A pair of offsetting mating arms 42*d* extending downwardly from the upper connecting arms 44*d*. The relationships between the power contacts 4*d* and the insulative housing 2*d* are similar to those of the first embodiment, so descriptions thereabout are omitted herefrom.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for electrically receiving a daughter PCB, comprising:

an insulative housing comprising a receiving slot for insertion of the daughter PCB and a tower, said receiving slot dividing the tower into a pair of opposite base portions;

a signal terminal being retained in the insulative housing and adapted for electrically connecting with the daughter PCB; and a power contact being retained in the tower and adapted for electrically connecting with the daughter PCB, said power contact comprising a pair of retaining plates respectively retained in the base portions and a connecting arm connecting the retaining plates for supporting the daughter PCB.

2. The electrical connector as described in claim 1, wherein the power contact comprises a pair of soldering tails respectively offsetting from a bottom end of the retaining plates and a pair of mating arm extending from a lower end of the retaining plates for contacting with the daughter PCB.

3. The electrical connector as described in claim 1, wherein the housing further comprises a base and the tower extends beyond a top surface of the base.

4. A power contact retained in an electrical connector and adapted for electrically connecting a daughter PCB and a mother PCB, comprising:

a retaining plate adapted for being engageably received in the electrical connector;

a soldering tail extending downwardly from the retaining plate adapted for soldering onto the mother PCB;

a mating arm extending inwardly from the retaining plate adapted for electrically connecting with the daughter PCB; and a connecting arm extending from the retaining plate and being adapted for engageably received in the daughter PCB.

5. The power contact as described in claim 4, wherein the mating arm and the retaining plate are locate on two different parallel surfaces.

6. The power contact as described in claim 4, wherein the mating arm extends from a bottom end of the retaining plate.

7. The power contact as described in claim 4, wherein the mating arm extends from a bottom end of the retaining plate.

8. The power contact as described in claim 4, wherein the mating arm extends from an inner side of the retaining plate.

9. An electrical connector assembly comprising:

an insulative housing defining an elongated central slot extending along a longitudinal direction thereof;

two rows of signal contacts located by two sides of the central slot;

a tower located around one end of said housing, said central slot extending into the tower;

a plurality of power contacts located in the tower along said longitudinal direction, each of said power contacts including a shielding plate with a pair of mating arms located by said two sides of the central slot; and a daughter board received in the central slot to engage the signal contacts and mating arms of the power contacts; wherein in each of said power contacts, the shielding plate defines a first plane and said pair of mating arms defines a second plane offset from said first plane along said longitudinal direction.

10. The assembly as described in claim 9, wherein each of said power contacts defines a portion crossing the central slot.

11. The assembly as described in claim 9, wherein said daughter board defines a notch receiving said portion therein.

12. The assembly as described in claim 11, wherein the mating arms of the power contacts and the signal contacts are essentially located at a same level which is lower than another level the shielding plates of the power contacts are located at.

* * * * *